United States Patent [19]

Müller

[11] Patent Number: 4,905,986

[45] Date of Patent: Mar. 6, 1990

[54] TRANSPORT APPARATUS FOR FLAT PRODUCTS WITH INDIVIDUALLY CONTROLLABLE GRIPPERS

[75] Inventor: Erwin Müller, Oberdürnten, Switzerland

[73] Assignee: Ferag AG, Hinwil, Switzerland

[21] Appl. No.: 219,206

[22] Filed: Jul. 15, 1988

[30] Foreign Application Priority Data

Jul. 21, 1987 [CH] Switzerland ..... 02753/87

[51] Int. Cl.[4] ..... B65H 5/14; B65H 29/04; B65G 17/12

[52] U.S. Cl. ..... 271/277; 271/204; 198/803.9

[58] Field of Search ..... 271/82, 85, 268, 277, 271/204, 205, 206; 198/470.1, 803.7, 803.9

[56] References Cited

U.S. PATENT DOCUMENTS

| | | | |
|---|---|---|---|
| 3,809,214 | 5/1974 | Reist | 271/204 X |
| 3,955,667 | 5/1976 | Muller et al. | 271/204 X |
| 4,072,228 | 2/1978 | Honegger et al. | 198/803.7 X |
| 4,320,894 | 3/1982 | Reist et al. | 271/277 |
| 4,505,378 | 3/1985 | Statkus | 271/277 X |
| 4,512,457 | 4/1985 | Reist et al. | 198/470.1 |
| 4,746,007 | 5/1988 | Houseman | 271/204 X |

FOREIGN PATENT DOCUMENTS

| | | | |
|---|---|---|---|
| 2272936 | 12/1975 | France . | |
| 1185606 | 3/1970 | United Kingdom . | |
| 86/03476 | 6/1986 | World Int. Prop. O. | 198/803.9 |

*Primary Examiner*—Joseph J. Rolla
*Assistant Examiner*—Edward S. Ammeen
*Attorney, Agent, or Firm*—Bell, Seltzer, Park and Gibson

[57] ABSTRACT

Grippers or gripper elements are attached at conveyor chain links of a revolvingly driven conveyor chain. The leading edges of each product of an imbricated product formation, in which each product bears upon the next following or trailing product, comes to lie on a clamping jaw of an associated gripper or gripper element and is engaged from above by a clamping element, such as a clamping finger of such gripper or gripper element. The product conveying direction of the transport apparatus and the product conveying direction of an infeed device delivering the products are in the same direction at a product take-over region of the transport apparatus. During the closing motion of the clamping finger of the gripper or gripper element this clamping finger raises a region or portion of the preceding or leading product which covers the leading edge of the trailing product which is to be engaged by such gripper or gripper element.

15 Claims, 4 Drawing Sheets

TRANSPORT APPARATUS FOR FLAT PRODUCTS WITH INDIVIDUALLY CONTROLLABLE GRIPPERS

CROSS-REFERENCE TO RELATED APPLICATION

This application is related to the commonly assigned, copending U.S. Application Ser. No. 07/219,202 filed July 15, 1988, and entitled "METHOD AND APPARATUS FOR PROCESSING PRODUCTS ARRIVING IN AN IMBRICATED FORMATION, ESPECIALLY PRINTED PRODUCTS", to which reference may be had and the disclosure of which is incorporated herein by reference.

BACKGROUND OF THE INVENTION

The present invention broadly relates to a new and improved construction of a transport apparatus or installation for substantially flat or superficial products, especially printed products or the like.

Generally speaking, the transport apparatus or installation of the present development is of the type comprising a plurality of individually controllable grippers or gripper elements which are arranged in succession or behind one another at at least one revolvingly driven traction element as viewed with respect to a predeterminate direction of conveying or conveyance or feed of the products. Each of the individually controllable grippers or gripper elements comprises a clamping jaw and a clamping element, herein generally referred to as a clamping finger, for engaging the substantially flat or superficial products, especially printed products at their leading edges. These products are delivered by an infeed device in an imbricated formation in which each product bears upon the following or trailing product. At a product take-over region the product comes to bear upon the clamping jaw and during a closing movement of the clamping finger, such product is engaged from above.

There prevail imbricated formations of products in which the products are arranged in reposing or bearing contact with one another in imbricated or shingled formation and each product bears upon the next following or trailing product. In such type of imbricated product formation, the leading edge of each product, here then the trailing product, is covered by the preceding or leading product. If such products disposed in such type of imbricated formation must be engaged at their leading edges or regions by grippers or gripper elements for the further transport thereof, then the problem exists that such leading edges are not freely accessible from above. In such imbricated formations of products, the leading edge is usually constituted by the end of the product, the so-called flower or cut portion, which is situated opposite the product fold which is formed upon folding of the products. The engagement of the individual products at their flower or cut portion is difficult because they can fan apart or open at such location.

In Swiss Patent No. 630,583, and the cognate U.S. Pat. No. 4,320,894, granted Mar. 23, 1982, there is disclosed a transport apparatus for such imbricated formations of products, wherein the grippers or gripper elements thereof engage the product at the leading edges, which in this case, however, are formed by the product folds. This transport apparatus serves to further transport the products with the same product arrangement or disposition, in other words, there is maintained the mutual position of the products and the leading edges. The conveying direction of the transport apparatus extends from a lower position to an upper position and transverse to the plane of the products which are to be engaged or seized. The first product of the imbricated or shingled formation is engaged by a gripper at the leading product edge which is not covered or obstructed by any other product and then raised, so that the leading edge of the immediately next following or trailing product which is to be engaged or grasped is freely exposed. In other words, with this prior art transport apparatus the individual products of the imbricated formation are so-to-speak peeled off and the previously covered leading product edges are exposed or laid free. The grippers or gripper elements must be pivotably arranged at a traction element so as to be able to pivot about an axis extending transversely with respect to the product conveying direction and at least at the product take-over region these grippers or gripper elements must be aligned such that the clamping jaws and the clamping fingers can engage the products without damage thereto.

SUMMARY OF THE INVENTION

Therefore with the foregoing in mind it is a primary object of the present invention to provide a new and improved construction of a transport apparatus for substantially flat products, especially printed products, which affords exceedingly reliable, positive and protective engagement of the products arriving in an imbricated or shingled product formation.

Another and more specific object of the present invention, aims at the provision of a new and improved construction of transport apparatus for substantially flat or superficial products, especially printed products, wherein the products arrive in an imbricated formation with each product having the leading edge or portion thereof covered by the immediately preceding or leading product, wherein the individual products can be engaged at the leading edges in such imbricated formation without the need to expose or lay bare such leading product edges and such is even possible when the leading edges of the products constitute the cut portion or flower.

Yet a further significant object of the present invention aims at the provision of a new and improved construction of transport apparatus for substantially flat or superficial products, especially printed products, which transport apparatus is relatively simple in construction and design, relatively economical to manufacture, highly reliable in operation, and affords protective but positive engagement of the products at leading portions thereof so that the products can be further reliably transported in a predeterminate direction of motion or product conveying or conveyance direction.

A further noteworthy object of the present invention resides in the provision of an improved construction of transport apparatus which allows products which arrive in an imbricated formation and which have the leading product edges covered by, in each case, the immediately preceding or leading product, in other words the downstream located product with respect to a predeterminate direction of conveyance of the products, to be engaged by grippers or gripper elements in a highly reliable and protective fashion.

Still a further important object of the present invention is directed to the provision of an improved construction of transport apparatus for substantially flat products arriving in imbricated product formation, wherein there are provided means for raising an immediately preceding or leading product so that there can be engaged the leading edge of the next following or trailing product at a desired location.

Now in order to implement these and still further objects of the invention, which will become more readily apparent as the description proceeds, the transport apparatus or installation of the present development is manifested, among other things, by the features that the product conveying or conveyance direction of the transport apparatus and the product conveying or conveyance direction of the infeed device are in the same direction at the product take-over region. The clamping element or finger of each gripper or gripper element, during the closing movement of such clamping element or finger, raises a portion or predeterminate region of a preceding or leading product, viewed with respect to the direction of conveying or conveyance of the products, and which product region covers the leading edge of the product to be engaged or grasped.

Since the product conveying direction of the transport apparatus and the product conveying direction of the infeed device are equally directed, the products beneficially do not experience any transverse accelerations, thus reducing the danger of damage to the products. The clamping finger of each gripper or gripper element advantageously forms or provides for itself the access space it needs for rendering the leading edge of the product which is to be engaged or grasped available in that it raises the region of the preceding or leading product which covers the leading edge of the next following or trailing product which is to be engaged. The gripper or gripper element engages the product of the imbricated product formation from below so that even leading edges or portions of products which can fan apart or spread open can be engaged because fanning or opening of the leading edges of such products is precluded by the inherent weight of the products. Additionally, it is not necessary to pivot the grippers or gripper elements in relation to the traction element since both of the aforementioned product conveying directions are the same, in other words, directed in the same sense.

The closing movement of the clamping finger is preferably a pivotal movement which is directed opposite to the product conveying or conveyance direction. Moreover, the apex or highest point or zenith of the path of motion of the clamping finger is disposed higher than the path of motion or movement of the clamping jaw. Consequently, there is attained in a simple manner the result that each product is engaged from above and at the leading product edge and at the same time the preceding or leading product is raised at the region covering the leading edge of the next neighboring trailing product, so that there is effectively made available space for the faultless engagement or grasping of the leading product edge.

A particularly simple drive arrangement or drive means for the clamping finger or finger member comprises a crank drive containing an oscillating crank slot, wherein the clamping finger is arranged at or to define the connecting rod of the crank drive. Consequently, there is attained a path of movement for the clamping finger or finger member which, towards the end or completion of the closing movement, is disposed almost perpendicular to the plane of the product which is to be engaged or grasped. The products are thus only loaded in compression and not in shear, thereby reducing the danger of damaging the products.

Powering or driving of the crank drive is preferably accomplished by a displaceable or slidable plunger or plunger member which is mounted at a support or carrier member. The plunger member is provided with teeth or a toothed portion which engages with a pinion connected rigidly for rotation with the crank drive. The lengthwise movement of the plunger is thus converted in a most simple fashion into a desired pivotal motion of the clamping finger of the related gripper or gripper element.

According to a preferred embodiment of the transport apparatus, two synchronously revolvingly driven traction elements are arranged substantially parallel and in spaced relationship from one another, and the products are then engaged or seized at both of the end or lateral regions of their leading edges. The space between both of the traction elements is thus free and is available for accommodating infeed and outfeed devices for the products.

Preferably the plunger or plunger member is controlled at the product take-over region by a cam structure or cam, and at the same time a relief or unlocking cam releases a clamping or locking element so that it can move out of its clamping or locking position with respect to the related plunger or plunger member. The cams need only be provided at the product take-over region or zone and can be designed through the use of very simple means or structure.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Describing now the drawings, it is to be understood that to simplify the showing thereof, only enough of the construction of the transport apparatus or installation for the transport or conveyance of substantially flat or superficial products, especially printed products, has been illustrated therein as is needed to enable one skilled in the art to readily understand the underlying principles and concepts of this invention. It is also to be understood that the term "product" is used herein in a general sense to denote various types of substantially flat or superficial products, articles or structures which can be handled by the transport apparatus or installation of the present development, such being typified by printed products, like newspapers, magazines, periodicals or the like.

Figure 1:
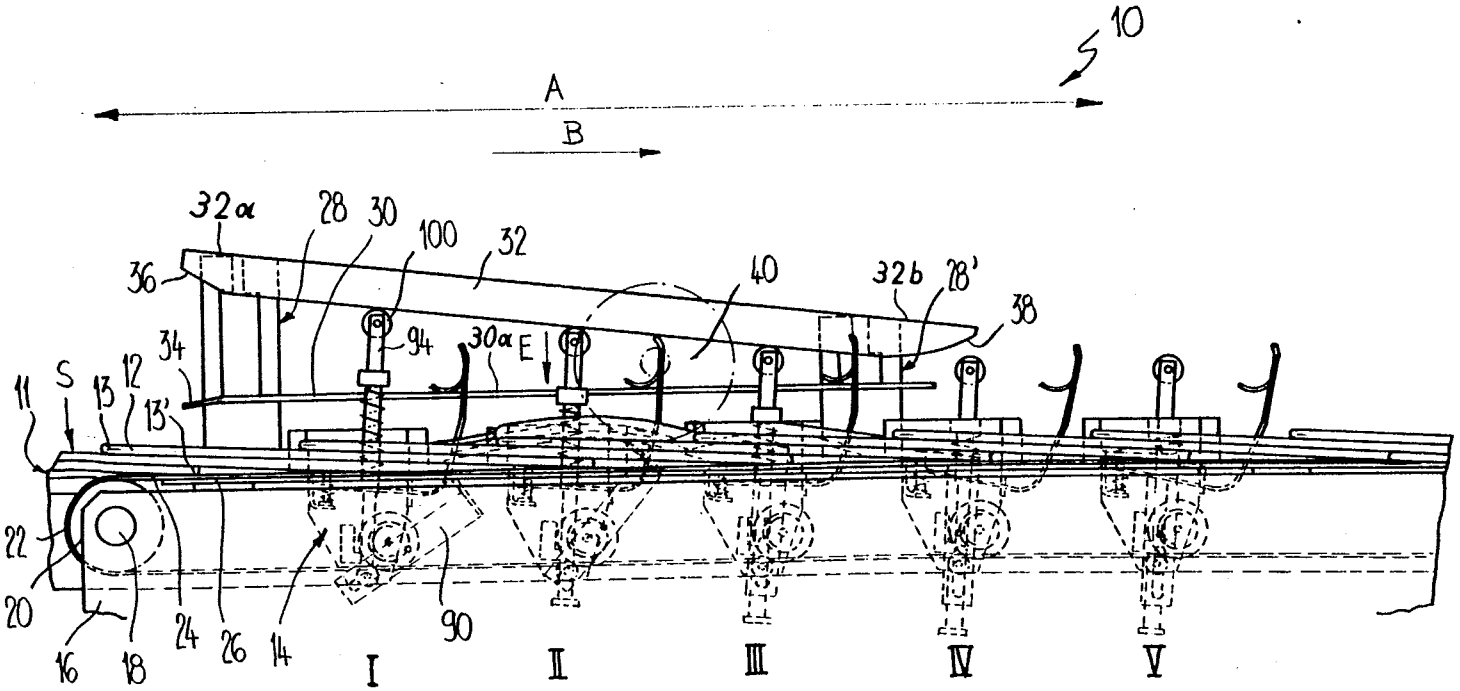
FIG. 1 is a side view of the product take-over region or zone of the transport apparatus depicting the same gripper or gripper element in five different positions during and shortly following the gripper closing movement.

Turning attention now to FIG. 1 of the drawings, there is depicted therein an exemplary embodiment of transport apparatus or installation 10 which contains a product take-over or engagement region or zone A. The substantially flat or superficial products 12 which are delivered in an imbricated formation S by a conventional product infeed or delivery device 11, which thus has only been partially schematically shown at the left-hand side of FIG. 1, are engaged or seized by the transport apparatus 10 and further transported in a predeterminate direction of movement or conveyance B of the infed imbricated formation S of the flat products 12. These products 12 are arranged in reposing orientation upon one another in a shingled or imbricated array in the imbricated formation S such that each product 12 bears upon the next following or trailing product 12 with respect to the product direction of movement or conveying or conveyance direction B. A trailing edge of each product 12 is here shown to be constituted by a product fold 13 about which there has been folded the product 12, whereas a leading product edge 13' is here shown constituted by the end or region of each product 12 which is remote from the fold 13. Therefore, the leading edge 13' of each product 12 constitutes the so-called cut portion or flower of the product which can be fanned or spread apart. As already indicated previously, the products 12 are, in particular, folded printed products, such as newspapers, periodicals, magazines or the like or component parts or insert portions thereof.

Continuing, it is to be understood that to preserve clarity of the illustration, FIG. 1 shows only a single gripper or gripper element 14 which has been depicted in five different positions I, II, III, IV and V. These five different positions I to V of each gripper or gripper element 14 are successively assumed by each such gripper or gripper element 14 in the predeterminate direction of movement or conveying direction B of the products.

As concerns the function of each gripper element 14 and the significance of the successive operating positions I to V depicted in FIG. 1, such will be considered in greater detail during the further course of this disclosure.

At this point it is noted that at a merely partially schematically illustrated frame or frame member 16 of the transport or conveyor apparatus 10, there is arranged a rotary or rotational shaft or shaft member 18 of a rotatably mounted deflection roll or roller 20. Trained about the deflection roll 20 is a revolvingly driven endless band or belt 22. A conveying-active run 24 of this endless band or belt 22 moves in the product direction of movement or conveying direction B upon a support or carrier plate or plate member 26 which is attached at the frame or frame member 16. A second deflection roll, which is further spaced in the product direction of movement B from the product take-over region or zone A, has not been particularly depicted in FIG. 1 of the drawings, but would be located at the right-hand region thereof.

Furthermore, as will be subsequently explained with reference to FIG. 2, a pair of deflection rolls, like the deflection roll 20 can be arranged adjacent one another and with each such roll trained by an associated endless band or belt, like the endless band 22. Equally, at the opposite side of the transport apparatus 10, remote from the observer of FIG. 1, there can be provided a similar arrangement of grippers or gripper elements 14 and associated structure so that the products 12 can be engaged at opposite ends or lateral regions. Due to this possibility of the design of the transport apparatus or installation 10 it will, however, suffice to consider the construction of the transport apparatus and the related grippers or gripper elements 14 and associated structure at one side of such transport apparatus 10.

At the depicted frame or frame member 16 there is also appropriately mounted a cam frame or frame structure 28 and 28' at which there are arranged two cams or cam members or equivalent structure, here a so-called load-relief or unlocking cam 30 for the gripper elements 14 and a closure cam or cam member 32 for such gripper elements 14. These cams or cam members 30 and 32 extend approximately over the extent of the product take-over or engagement region or zone A. The load-relief or unlocking cam 30 extends essentially parallel to the support or carrier plate 26. A run-on or guide nose or nose member 34, which is bent in the direction of the support or carrier plate 26, is arranged upstream or forwardly of the cam portion **30*a* of the load-relief unlocking cam 30 which is disposed substantially parallel to the support or carrier plate 26. On the other hand, the spacing or distance between the gripper closure or closing cam or cam member 32 and the support or carrier plate 26 decreases in the product direction of movement or conveying or conveyance direction B, as evident from the showing of FIG. 1. At the starting region 32*a* and the end or terminal region 32*b* of the gripper closure or closing cam 32 there are provided the infeed nose 36 and outfeed nose 38, respectively. Also depicted in FIG. 1, is a contact or press-on roll or roller member 40** in chain-dot or phantom lines.

Figure 2:
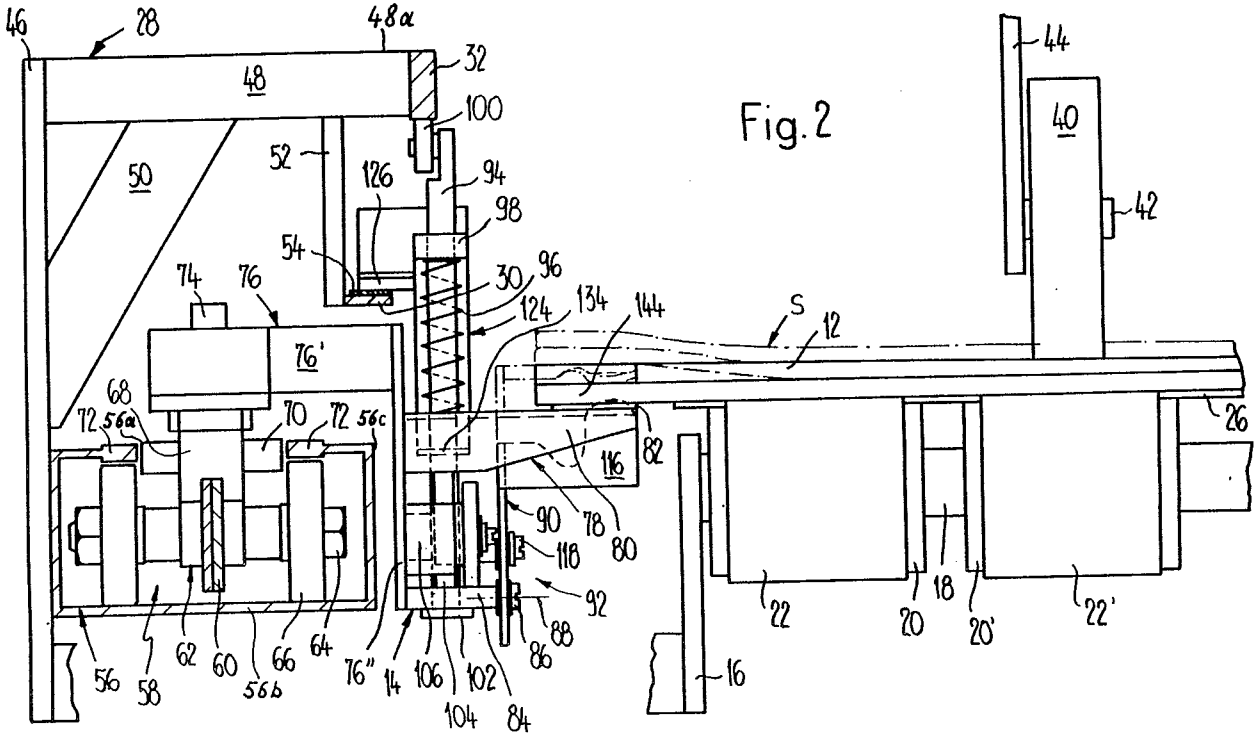
FIG. 2 is an enlarged end view, partially in section, of the transport apparatus of FIG. 1 and viewed in the product conveying or feed direction.

With reference now to FIG. 2, at the rotary or rotational shaft 18 arranged at the frame or frame member 16 there are depicted two deflection rolls or rollers 20 and 20' which are rotatably mounted by the rotary or rotational shaft 18. The conveying-active run of each of the bands or belts 22 and 22' cooperating with the deflection rolls 20 and 20', respectively, slide upon the support or carrier plate 26. Bearing upon the conveying-active run of the endless bands or belts 22 and 22' is the imbricated formation or stream S of products 12. The contact or press-on roll 40 is rotatably mounted at a rotary or rotational bolt or bolt member 42 which is secured to a contact or press-on lever 44. This contact or press-on lever or lever member 44 is pivotably mounted in conventional fashion at the frame or frame member 16 which is not depicted in FIG. 2.

The cam frame or frame structure or member 28 comprises a frame plate or plate member 46, a cantilever arm or structure 48 appropriately connected, for instance by welding, with the frame plate 46 and a diagonal support or strut 50 as well as a gripper load-relief or unlocking cam support or carrier 52 attached, for instance again by welding, at the cantilever arm 48. The gripper closure or closing cam 32 is secured at the distal or free end **48*a* of the cantilever arm 48, and at the load-relief or unlocking cam support 52 there is secured the gripper load-relief or unlocking cam or cam member 30. A slide protective member or covering 54 is arranged upon the load-relief or unlocking cam 30**, as readily seen by inspecting FIG. 2. The other cam frame 28' is similarly constructed as the cam frame 28. It also will be understood that the cam frames or frame members 28 and 28' need not be absolutely designed as a welded frame structure.

The frame plate or plate member 46 is arranged at a channel or channel member 56. This channel 56 has a substantially C-shaped shape or configuration in section, as shown in FIG. 2, and the opening 56*a* thereof is upwardly directed. Displaceably guided in the channel 56 is a suitable traction element, here constructed as a conveying or conveyor chain or chain member 58. This conveying chain 58 comprises a number of conveying chain elements 62 arranged in tandem or successively with respect to the product movement or conveying direction B and interconnected with one another by means of connecting elements or links 60. At each conveyor chain element 62, there are rotatably mounted at the opposite ends thereof, a pair of guide wheels or rollers 66 by means of two threaded bolts or bolt members 64, as particularly evident by inspecting FIGS. 2 and 3. At each conveyor chain element 62 there is provided a protruding or neck portion 68 which extends or protrudes through the opening 56*a* of the substantially C-shaped channel 56. At the height of the opening 56*a* of the channel 56 there is rotatably mounted at the protruding or neck portion 68 a guide roll or roller 70. This guide roll or roller 70 serves to center the related conveying chain element 62 of the conveying or conveyor chain 58 in the substantially C-shaped channel 56 and to that end, can bear upon enlarged portions 72 of the C-shaped channel 56 arranged to both sides of the channel opening 56*a*, as shown in FIG. 2. The guide wheels or rollers 66 travel upon the base or floor 56*b* of the substantially C-shaped channel 56. However, they can also bear upon the enlarged portions 72. Since the conveyor chain 58 is constructed as an endless chain such is particularly then the case when the protruding or neck portions 68 depend downwardly during the return motion of the conveying chain 58.

Figure 4:
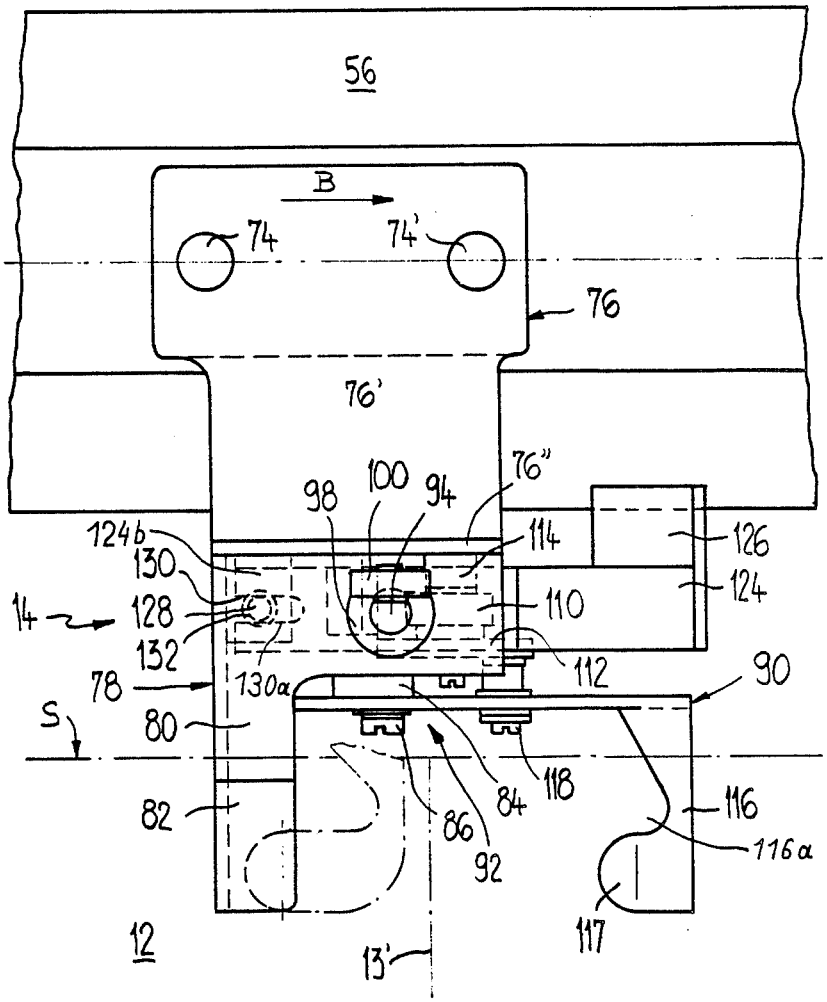
FIG. 4 is a top plan view of the gripper or gripper element depicted in FIG. 3.

As will be seen by referring to FIGS. 2 and 4, at each protruding or neck portion 68 there is attached a support or carrier member 76 of a related gripper or gripper element 14 by means of two attachment bolts 74 and 74' or equivalent fastening expedients. The support or carrier member 76 is here shown constructed as a one-piece substantially L-shaped member, wherein the horizontal leg or leg portion 76' is secured in the manner described above at the related conveyor chain element 62, whereas the second leg or leg portion 76" is downwardly directed substantially parallel to the sides 56*c* of the substantially C-shaped channel or channel member 56. In any event, the leg or leg portion 76" is sufficiently spaced from the channel or channel member 56 such that this leg 76" does not come into contact with the channel 56.

Based upon the illustration of FIGS. 2 to 4, there will now be described the construction of one of the grippers or gripper elements 14 in greater detail. As will be particularly well seen by referring to FIG. 3, the leg or leg portion 76" comprises an unequal sided member, for instance a sheet metal member 76*a* of substantially hexagonal configuration but having unequal length sides or legs, wherein the downwardly directed side edges 76*b* which intersect at an acute angle, are bounded by a lower edge or leg 76*c* which extends approximately parallel to the base or floor 56*b* of the C-shaped channel 56 and along the level or height thereof. At the leg or leg portion 76" there is affixed, for instance by welding, a clamping jaw or jaw member 78. As will be seen from FIG. 3, the clamping jaw 78 comprises a substantially C-shaped member 78*a*, for instance a bent sheet metal member which is downwardly open and at which, viewed in the product direction of movement or conveying direction B, there is formed at the trailing end a clamping jaw projection or protrusion 80 (see also FIG. 4). From the illustration of FIGS. 2 and 4, it will be particularly evident that the clamping jaw projection or protrusion 80 extends into the region of the imbricated formation S of products 12 and at that location is provided with a jaw support or contact member 82. As will be explained more fully hereinafter, each of the products 12 come to bear upon a related jaw support or contact member 82.

As particularly shown in FIG. 2, at the lower end of the leg or leg portion 76" there is arranged a guide or guide plate member 84. Secured in the guide plate 84 is a pivot bolt 86 or the like, about the lengthwise axis 88 of which there is pivotably mounted a clamping element, here shown as a clamping finger or finger member 90. A drive arrangement or drive means 92, likewise arranged at the leg or leg portion 76", acts upon the clamping finger 90.

This drive arrangement or drive means 92 comprises a still to be discussed crank drive or transmission and a plunger or plunger member 94 which acts upon such crank drive. The plunger 94 is slidingly guided in the clamping jaw 78 and in the guide plate 84 for movement approximately transverse to the product movement or conveying direction B. A compression or pressure spring 96 is arranged about the plunger 94. One end of this compression spring or spring member 96 bears upon the clamping jaw 78 and at the other end is supported at a plunger collar or shoulder 98 which is secured to the plunger or plunger member 94. At the upper end of the plunger 94 there is rotatably mounted thereat a cam follower or follower roll 100. At the lower end of the plunger 94 there is secured thereto an impact or stop disc 102 or equivalent impact or stop means or structure.

Figure 3:
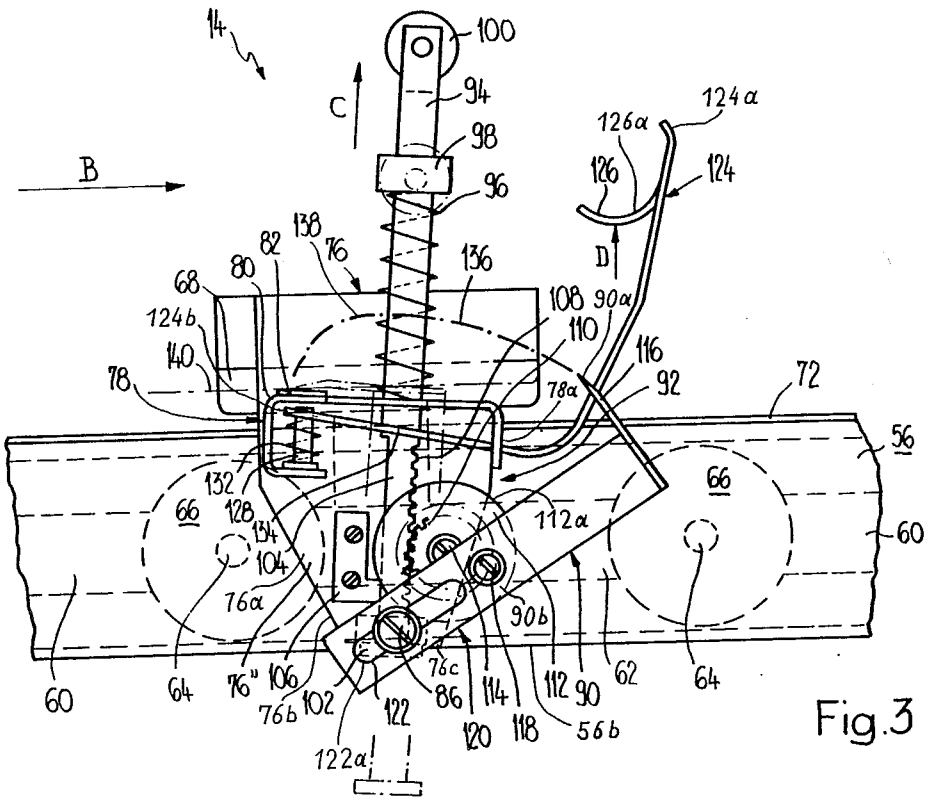
FIG. 3 is an enlarged side view of the gripper or gripper element depicted in the arrangement of transport apparatus shown in FIG. 1 and illustrating such gripper or gripper element in its opened condition or state.

In the plunger position depicted in FIG. 3 the impact disc or stop means 102 bears against the guide plate 84 and prevents movement of the plunger 94 in the direction of the arrow C. A slide portion 104, defining a slide plane, is machined, for instance milled at the plunger 94. This slide portion 104 is mounted in a slide or guide shoe or block 106 and is guided thereby. The slide shoe 106 is formed of, for instance, a suitable plastics material and is attached by threaded bolts or other suitable attachment or fixing means at the leg or leg portion 76". This slide shoe or block 106 prevents the plunger or plunger member 94 from undesirably rotating about its lengthwise or longitudinal axis. A toothed portion or teeth means 108 are arranged at the plunger or plunger member 94 opposite the slide portion 104 defining the slide plane for the sliding plunger 94. This tooth portion or teeth means 108 coact with a pinion 110. A crank or crank unit 112, here shown in the form of a disc or plate member 112*a*, is rigidly connected for rotation with the pinion 110. This pinion 110 and the crank or crank unit 112 are rotatably mounted at a shaft or shaft member 114 which is arranged at the leg or leg portion 76"

The clamping element in the form of the clamping finger or finger member 90 is advantageously designed as a one-piece element or structure. The end 90*a* of the clamping finger 90, located remote from the pivot bolt or bolt member 86, is flexed and forms a clamping finger jaw or jaw member 116. At the central region 90*b* of the clamping finger 90, the latter is rotatably mounted by means of a shaft or shaft member 118 at the crank or crank unit or structure 112. Hence, this clamping finger 90 forms a connecting rod 120 of the crank drive. This connecting rod or rod member 120 has a crank slot 122 constructed as an elongate hole or opening 122*a* and such crank slot 122 is mounted at the pivot bolt or bolt member 86.

As best seen by referring to FIG. 4, the clamping finger jaw or jaw member 116 has a substantially V-shaped cut-out or recess 116*a* so that the protruding free end 117 of the clamping finger jaw 116, when the corresponding gripper or gripper element 14 is closed, as shown in chain-dot or phantom lines in such FIG. 4, bears upon the jaw support 82 of the coacting clamping jaw or jaw member 78 or upon the upper side or face of the engaged product 12, as the case may be. The free end 117 of the clamping finger jaw 116, as viewed from the side, possesses a substantially arrow-shaped configuration, as evident from the illustration of FIG. 3.

As also will be observed by referring to such FIG. 3, at the downwardly flexed part 78*a* of the clamping jaw 78, which part 78*a* leads when viewed in the product movement direction or conveying or conveyance direction B, there is pivotably mounted a clamping or locking element 124. At one end 124*a* of the clamping or locking element 124, there is formed or provided an actuating or operating member 126*a* in the form of a slide curved or arcuate portion 126 and at the other end 124*b* the clamping or locking element 124 is slidably mounted at an associated guide bolt or bolt member 128 which is arranged at the clamping jaw or jaw member 78. For this purpose, and as will be seen by inspecting FIG. 4, the clamping or locking element 124 is provided at the end or end region 124*b* with a cut-out or recess 130, the side edges or walls 130*a* of which slide at the guide bolt 128. A further compression or pressure spring 132 arranged about the guide bolt 128 and bearing at the clamping jaw 78, acts upon the clamping or locking element 124 at the region of the cut-out or recess 130. The plunger or plunger member 94 piercingly extends through the clamping or locking element 124 by means of a clamping opening 134 provided in the clamping element 124.

Based upon the illustrations of FIGS. 3 and 4, there now will be described the function of a gripper or gripper element 14. In such FIGS. 3 and 4, the gripper element 14 is illustrated in an open position and the closed position thereof is illustrated in chain-dot or phantom lines. The diameter of the aforementioned clamping opening 134 is only slightly greater than the diameter of the plunger or plunger member 94. By virtue of the pivoting or rocking of the clamping or locking element 124 in the clockwise direction under the force of the compression or pressure spring 132, the edge or marginal portion of the clamping opening 134 bears against the plunger 94, so that this plunger 94 is clamped or locked in the full or solid line illustrated position (see FIG. 3). By applying a force in the direction of the arrow D upon the clamping or locking element 124, the latter is rotated or turned in the counter-clockwise direction against the force of the compression or pressure spring 132. Hence, the clamping opening 134 now releases the plunger or plunger member 94.

Due to the application of a force upon the cam follower or follower roll 100, opposite to the direction of the arrow C, the plunger 94 is slidingly moved in downward direction against the force of the compression or pressure spring 96. The toothed portion or teeth means 108 cause a rotation of the pinion 110 and thus the crank 112 in the counter-clockwise direction. The free end 117 of the clamping finger jaw 116 describes a path of movement 136 which is directed opposite to the product movement or conveyance direction B. An apex or zenith point or region 138 of this path of movement 136 is located above a path of movement 140 of the clamping jaw or jaw member 78.

Upon releasing the clamping or locking element 124, the latter moves in clockwise direction, under the action of the force of the compression or pressure spring 132, until the edge of the clamping opening 134 again clampingly or lockingly bears at the plunger 94 and fixedly retains such plunger in the closed gripper position. In order to move the clamping finger 90 back into the open position thereof, the clamping or locking element 124 is again moved in the counter-clockwise direction in a manner as previously described. Under the force of the compression spring 96 the plunger 94 moves out of the chain-dot or phantom line depicted position in the direction of the arrow C until the impact disc 102 or the like, bears against the guide plate 84, the plunger 94 thus again assuming its original position. During such time the crank 112 is driven so as to rotate in the clockwise direction and the free end 117 of the clamping finger jaw or jaw member 118 moves back along the same path of motion 136 into the open position. Since this free return motion of the plunger 94 back into its original position is accomplished at an appreciable acceleration, the plunger movement is advantageously controlled as will be explained more fully hereinafter.

At this junction there will be described in greater detail the function of the transport apparatus 10 primarily based upon the illustration of FIGS. 1 and 2. The grippers or gripper elements 14 are arranged in succession or behind one another, viewed in the product movement or conveying direction B, at the revolving conveyor chain or chain member 58. Each gripper element 14 engages a product 12 at the product take-over region A and further transports the engaged product 12. The tandemly arranged gripper elements 14 are positioned at the same mutual spacing from one another, as such has been depicted in FIG. 1. However, it should be recalled that in the illustration of FIG. 1, the same gripper or gripper element 14 has been portrayed in five different operating positions I to V. To improve clarity in illustration and comprehension of the operation of the transport apparatus 10, the further grippers or gripper elements 14 have not been illustrated in FIG. 1.

The products 12 of the imbricated or shingled formation S infed by means of the infeed or delivery device 11, come to bear on the conveying-active run 24 of the endless bands or belts 22 and 22'. The endless bands 22 and 22' move at the same velocity as the conveyor chain 58 in the product movement or conveying direction B. The gripper element 14, while in its open position, is guided to the product take-over or engagement region A and the jaw support 82 comes to bear from below at the leading edge 13' of the product 12 which is to be engaged or grasped. The slide curved or arcuate portion 126, defining the actuating or operating member 126*a* of the clamping or locking element 124, travels onto the run-on nose or nose member 34, resulting in the clamping or locking element 124 (see also FIG. 3) being moved in counter-clockwise direction and the release of the plunger or plunger member 94. The cam follower roll 100 initially comes into contact with the infeed nose or nose member 36 and then contacts the closure or closing cam 32 (position I).

As a result, due to the movement of the gripper element 14 in the product movement or conveying direction B, the plunger 94 is moved downwardly in the direction of the arrow E (FIG. 1) resulting in the closing movement of the clamping finger 90. Since the clamping finger jaw 116, as has been already previously described, moves upwardly and opposite to the product movement or conveying direction B, the leading or downstream product 12 is upwardly raised or shifted (position II) at the region where it covers or overlies the leading edge 13' which is to be grasped or engaged of the immediately following or trailing product 14. Consequently, the leading product edge 13' is freed and due to the downward movement of the clamping finger 90 towards the end of the path of movement 136 the leading product edge 13' of the trailing product 12 which is to be engaged or grasped is positively clamped between the clamping finger 90 and the clamping jaw 78 (position III). The jaw support or contact member 82 prevents any damage to the engaged product 12.

In FIG. 1 there has been depicted at position II the manner in which the clamping finger or finger member 90 raises or domes the leading or preceding product 12. To ensure that the imbricated or shingled formation or array S of the products 12 is retained, the contact or press-roll 40 presses against the intermediate or central region of the products 12 and clamps the products 12 between the conveying-active run 24 of each of the belts 22 and 22' and such contact roll 40. In position III the engaged product 12 is still fixedly clamped and thereafter the slide curved portion 126 of the clamping or locking element 124 travels off of the load-relief or unlocking cam 30, with the result that the plunger 94 is positively clamped in the closed position thereof. Now at position IV the closure or closing cam 32 containing the run-off nose 38 releases the cam follower or follower roll 100 of the related plunger 94. However, the plunger 94 cannot move upwardly since it is positively retained in its product engaging position by the clamping or locking element 124, as such has been illustrated in positions IV and V of FIG. 1.

In order to open the gripper or gripper element 14 there is preferably arranged a load-relief or unlocking cam 30 and a closure or closing cam 32 such that the cam follower or follower roll 100 initially comes into contact or into operative association with the closure cam 32 and then releases or unlocks the clamping element 124 by virtue of the action of the load-relief or unlocking cam 30. By subsequently increasing the spacing between the support plate 26 and the closing cam 32, there is accomplished a slow continuous and controlled opening of the clamping finger or finger member 90.

It is here further mentioned that the contact or press-on roll or roller 40 can also be replaced by a revolving product contact system. This revolving product contact system or unit can comprise, for instance, a second contact or press-on roll or roller 40 and an endless band or belt disposed between the two contact rolls and revolving about such two spaced contact or press-on rolls.

The pivot bolt 86 also could be attached to the plunger 94. With that arrangement the movement of the clamping finger or finger member 90, opposite to the product movement or conveying direction B, would be accomplished more rapidly.

The supports or carrier members 76 also could be pivotably mounted at the traction element defined by the conveyor chain 58, in which case the pivot axis would be disposed perpendicular to the product movement or conveying direction B and would be located in a plane extending substantially parallel to the support or carrier plate 26.

The cams or cam members 30 and 32 are advantageously stationarily arranged, and the closure or closing cam 32 is resiliently secured at the cam frame structure or frame means 28 and 28'. The spring force between the cam frame means 28 and 28' and the closure or closing cam 32 must then be selected such that initially the plunger 94 is downwardly moved against the force of the compression or pressure spring 96 and, when the clamping finger 90 has reached the closed position thereof, the closure or closing cam 32 is pressed away in upward direction. With that design it is possible to advantageously engage or seize with the grippers or gripper elements 14, products 12 having the most different thicknesses without there being required an adjustment or setting of the closure cam or cam member 32.

As already indicated previously, there also could be provided two traction elements which would then extend essentially in paralellism to one another and which would be spaced at such a distance from one another that the clamping jaws 78 and clamping fingers 90 engage the products at two opposite end regions 144 of the leading products edges 13'.

The drive arrangement need not be absolutely constituted by a crank drive. Any other suitable drive arrangement or drive means is conceivable and which is capable of imparting to the clamping finger jaw or jaw member 116 or equivalent clamp structure or element a path of movement similar to the path of movement or motion 136.

If the products 12 have a length which is greater than twice the spacing of two successive grippers or gripper elements 14, then the immediately preceding or leading product 12 and the next immediately preceding or leading product 12 are both raised or domed by the clamping finger or finger member 90, as indicated also in FIG. 1.

It also should be understood that by means of the transport apparatus 10, it is possible to also process imbricated formations S of products 12 wherein the leading edges 13' of the products 12 are formed by the product folds or fold portions 13 or where the products themselves are constituted by individual sheets or signatures.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A transport apparatus for transporting substantially flat products infed in an imbricated formation for travel in a predeterminate direction of movement, especially printed products, comprising:

at least one revolvingly driven traction element;

a plurality of controllable gripper elements arranged behind one another as viewed in the predeterminate direction of movement of the products at the at least one revolvingly driven traction element;

each of said gripper elements comprising a clamping jaw and a clamping finger for engagement of the substantially flat products at leading product edges;

infeed means for infeeding the substantially flat products towards the at least one revolvingly driven traction element in an imbricated formation such that each product bears upon the next following product;

said transport apparatus comprising a product take-over region where the products come to bear upon the clamping jaws of the gripper elements;

means for displacing the clamping fingers of the gripper elements to perform a closing movement such that each clamping finger engages a related product from above;

said transport apparatus having a predeterminate direction of movement;

said infeed means having a predeterminate direction of movement;

said predeterminate direction of movement of the transport apparatus and said predeterminate direction of movement of the infeed means being essentially in the same direction at the product take-over region; and said means for displacing the clamping fingers moving each clamping finger during the closing movement thereof such that said clamping finger raises a region of a leading product, viewed with respect to the predeterminate direction of movement of the products, and which region covers a leading edge of a product which is to be engaged by the clamping finger.

2. The transport apparatus as defined in claim 1, wherein:

said means for displacing the clamping fingers comprises crank drive means;

said crank drive means comprise pivotably mounted connecting rod means; and said connecting rod means are coupled with the clamping fingers.

3. The transport apparatus as defined in claim 1, further including:

means for mounting the clamping finger of each gripper element so as to be pivotable about an axis extending substantially transverse with respect to the predetermined direction of movement of the products;

said means for displacing each clamping finger comprises drive means operatively coupled with the pivotable clamping finger such that during the closing movement of the clamping finger the direction of pivotal motion of the clamping finger is opposite to the predetermined direction of movement of the products; and each said clamping finger moving through a path of motion having an apex located higher than a path of motion of the clamping jaw of the gripper element.

4. The transport apparatus as defined in claim 3, wherein:

said means for displacing the clamping fingers comprises crank drive means provided for each clamping finger;

each said crank drive means comprises a pivotably mounted connecting rod; and said connecting rod is coupled with the clamping finger.

5. The transport apparatus as defined in claim 4, wherein;

said connecting rod having opposite end portions;

crank slot means being arranged at one end portion of the connecting rod;

said displacement means further including bolt means at which there is mounted the crank slot means;

said clamping finger being arranged at the other end portion of the connecting rod;

said connecting rod having an intermediate portion; and said crank drive means comprising crank means with which there is hingedly connected the intermediate portion of the connecting rod.

6. The transport apparatus as defined in claim 5, wherein:

said crank slot means is formed integrally with the connecting rod; and said clamping finger is formed integrally with the connecting rod.

7. The transport apparatus as defined in claim 5, further including:

pinion means fixedly connected for rotation with said crank means;

a slidable plunger provided for each gripper element;

support means for slidably mounting the slidable plunger;

said slidable plunger being provided with teeth means; and said teeth means of said slidable plunger engaging with said pinion means.

8. The transport apparatus as defined in claim 7, wherein:

said bolt means is connected to said support means.

9. The transport apparatus as defined in claim 8, further including:

a compression spring acting upon the slidable plunger;

said support means slidably mounting said slidable plunger for displaceable movement transverse to the predetermined direction of movement of the products against the force of the compression spring; and a clamping element for releasably fixedly clamping the slidable plunger.

10. The transport apparatus as defined in claim 9, further including:

a stationary load-relief cam arranged at the product take-over region;

said stationary load-relief cam releasing the clamping element for each slidable plunger out of a clamping position where said clamping element positionally locks said slidable plunger;

a stationary closure cam cooperating with each slidable plunger;

a follower element arranged at each slidable plunger; and said stationary closure cam acting upon the follower element of each slidable plunger in order to accomplish the closing movement of the clamping finger.

11. The transport apparatus as defined in claim 10, wherein:

said stationary closure cam comprises a resiliently structured closure cam in order to recede in a transverse direction in respect of a direction of movement of the respective gripper element after accomplishing the closing movement of the clamping finger.

12. The transport apparatus as defined in claim 1, further including:

channel means;

said at least one revolvingly driven traction element comprising a conveyor chain guided in said channel means;

support means provided for each of said gripper elements; and said support means being connected to said conveyor chain.

13. The transport apparatus as defined in claim 12, wherein:

each of said support means comprises a support member pivotably mounted for pivotable motion about a pivot axis extending transverse to the predeterminate direction of movement of the products.

14. The transport apparatus as defined in claim 1, further including:

press-on means provided at said product take-over region for pressing against the products.

15. The transport apparatus as defined in claim 14, wherein:

said press-on means comprises at least one press-on roll.

* * * * *